US008813302B1

(12) United States Patent
Capito

(10) Patent No.: US 8,813,302 B1
(45) Date of Patent: Aug. 26, 2014

(54) REUSABLE CLEANING HYBRID WEB GLOVE

(71) Applicant: Rita Capito, Mount Sinai, NY (US)

(72) Inventor: Rita Capito, Mount Sinai, NY (US)

( * ) Notice: Subject to any disclaimer, the term of this patent is extended or adjusted under 35 U.S.C. 154(b) by 0 days.

(21) Appl. No.: 13/800,433

(22) Filed: Mar. 13, 2013

Related U.S. Application Data

(60) Provisional application No. 61/610,158, filed on Mar. 13, 2012, provisional application No. 61/657,417, filed on Jun. 8, 2012, provisional application No. 61/714,865, filed on Oct. 17, 2012.

(51) Int. Cl.
*A47L 13/18* (2006.01)
*A41D 19/00* (2006.01)

(52) U.S. Cl.
CPC ..... *A47L 13/18* (2013.01)
USPC ..... 15/227; 2/159; 2/160; 2/161.6

(58) Field of Classification Search
CPC ..... A41D 19/00; A47L 13/18; A47L 13/19
USPC ..... 15/227; 2/158, 159, 160, 161.6, 20; D28/63; D32/35, 40
See application file for complete search history.

(56) References Cited

U.S. PATENT DOCUMENTS

| | | | | | |
|---|---|---|---|---|---|
| 742,440 | A * | 10/1903 | Johnson | 441/57 |
| 1,782,502 | A * | 11/1930 | Crane | 15/227 |
| 1,882,179 | A * | 10/1932 | Daly | 15/227 |
| 5,438,708 | A * | 8/1995 | Jacovitz | 2/161.6 |
| 5,979,007 | A * | 11/1999 | Soon | 15/227 |
| 6,530,108 | B1 * | 3/2003 | Brown et al. | 15/227 |
| 6,560,813 | B2 * | 5/2003 | Brown et al. | 15/227 |
| 6,748,605 | B1 * | 6/2004 | Brinkmann | 2/161.6 |

* cited by examiner

*Primary Examiner* — Mark Spisich
(74) *Attorney, Agent, or Firm* — Intellectulaw; P. B. Tufariello, Esq.

(57) ABSTRACT

A hybrid cleaning glove comprising a proximal end, a distal end, a palm covering body; and a seam-formed endoskeleton located between said palm covering body and said distal end, such that said seam-formed endoskeleton provides form-fitting finger sheaths and a webbing, whereby the cleaning surface of said hybrid cleaning glove is increased and the hand of a wearer of said hybrid cleaning glove is supported during use.

2 Claims, 3 Drawing Sheets

REUSABLE CLEANING HYBRID WEB GLOVE

CROSS-REFERENCE TO RELATED APPLICATIONS

This application claims priority from U.S. Provisional Application Ser. No. 61/610,158 filed on Mar. 13, 2012; U.S. Provisional Application Ser. No. 61/657,417 filed on Jun. 8, 2012; and U.S. Provisional Application Ser. No. 61/714,865 filed on Oct. 17, 2012; and which are all incorporated by reference in their entirety herein.

BACKGROUND OF THE INVENTION

1. Field of Invention

This invention relates to an apparatus and method for use primarily for cleaning and dusting. More particularly, the present invention relates to a cleaning tool; specifically to an improved dusting-cleaning, reusable, hand-supporting hybrid web glove.

2. Prior Art

The process of cleaning and dusting comprises a number of steps. Such steps include, but are not limited to identifying the item, object, device or surface that needs to be cleaned; determining the tools and cleaning solutions that need to be used to properly clean such items, objects, devices, and surfaces; beginning the cleaning process by wiping the surfaces that need to be cleaned; and terminating the cleaning process once the item, object, device or surface is clean.

Many of the tools used during the process of cleaning and dusting can include brushes, cleaning cloths, sponges, and cleaning gloves. When using a cleaning cloth, one typically clenches and holds such cleaning cloth in hand, to conform it and wrap it around the hand, so as to better wipe the surface that needs to be cleaned; or fold it to create a stiffness and a crease to reach into, under and around the surfaces that need to be cleaned, as well as to expose a proper cleaning surface. Such wrapping and folding, and re-folding, and clenching of the cleaning cloths in hand, wastes a lot of time. Further, it creates a lot of strain on the hand, particularly when cleaning over long periods of time. This in turn can lead to among other things, chronic arthritis in fingers and hands, or carpal tunnel syndrome, which become particularly acute with aging.

Many of the cleaning solutions that can be used to clean the device or object can include ammonia water, vinegar or a solution thereof, lemon juice or a solution thereof, hypochlorite solutions, oils, and so on, depending on the object, depending on the device, and depending on the surface that needs to be cleaned. However, such cleaning solutions more often than not, contain extremely harsh and abrasive chemicals, which are not only destructive to the environment, but can also dehydrate and destroy the skin on the user's hands, and should not be breathed in, since they do cause a number of respiratory conditions and ailments, including but not limited to asthma, as well as being potentially destructive to the items, objects, devices and surfaces on which they are used to clean.

For example, the use of acid or alcali cleaners, including ammonia or vinegar, for mirror cleanup is completely contraindicated by most mirror manufacturers, since either substance can attack the front surface and edges as well as the backing of a mirror. In fact so much so that the spraying of these chemicals directly on the surface of the mirror is totally contraindicated. Instead, the use of a cleaning cloth is highly recommended for the clean up of a mirror. Cleaners should be applied directly to a soft, lint-free cloth and then the cloth should be used to wipe the mirror, so that the cleaner is prevented from contacting the edges of the mirror and damaging them.

To deal with some of the problems set forth herein above, a number of cleaning gloves and mitts have been developed. Most of these gloves and mitts feature various modifications and contrivances which have been added to the glove and mitt, but render them bulky and cumbersome to use. However, most of these cleaning gloves and mitts are limited to one or two specific cleaning applications at most. Thus, most professionals still prefer a cleaning cloth over awkward ill-fitted mitts or gloves with limited usage, because the cloth is more adaptable to most cleaning situations; notwithstanding that its use can cause great pain to hands over prolonged periods of use.

Accordingly, there still exists a need for a device that can clean and dust without any harmful chemicals, can cut cleaning time by a significant amount, deliver high cleaning performance with little effort, is machine washable, while simultaneously providing maximum comfort and little fatigue over its long term cleaning and dusting use.

SUMMARY OF THE INVENTION

Accordingly, it is an object of the present invention to provide a hybrid web-glove that is capable of delivering high performance cleaning and dusting results, with very little effort and very little time.

It is a further object of the present invention to provide a hybrid web-glove that is capable of delivering high performance cleaning and dusting results without harsh and harmful chemicals or a large environmental footprint.

It is still another object of the present invention to provide a hybrid web-glove that is a cleaning, machine washable, reusable cleaning tool, while continuing to deliver superior cleaning and dusting results, time after time.

It is yet another object of the present invention to provide a hybrid web-glove designed to be used to clean with maximum comfort over a long period of time.

It is a further object of the present invention to provide a hybrid web-glove designed for cleaning and dusting, while simultaneously providing long term ergonomic hand support during the cleaning process.

It is yet another object of the present invention to provide a hybrid web-glove that is finger-fitted for maximum, relaxed hand control, stress free over a long period of time, thereby alleviating pain and discomfort.

In accordance with the present invention, there is provided a reusable hybrid web-glove, faintly reminiscent of a duck's webbed foot, which when used to cover a hand, simultaneously acts as a stress releasing covering for the hand of its wearer and a cleaning tool during the cleaning and dusting process. It comprises a proximate end, a distal end having an outer edge and an inner surface, and means for supporting the hand while simultaneously creating increased cleaning-surface webbing.

The proximate end has an opening through which the hand of the wearer can be inserted into the hybrid web-glove. The distal end of said reusable cleaning hybrid web-glove is quasi-circular, shaped in the form of the outer contour of a spread-fingered hand-print and dimensioned so that when the hand of the wearer is inserted into the hybrid web-glove, the outer edge of the distal end extends a bit beyond, and runs parallel to, around and along the outer contours of the wide-spread fingers of the hand of the wearer, generally beginning a bit below the base of the thumb area and tapering towards the wrist, at the side of the hand opposite the base of the thumb area to form and define the proximate end.

The inner surface of the distal end is provided with means that form sheath forming seams, while simultaneously creating increased cleaning surface webbing between said sheaths. The sheaths formed by the seams receive the fingers of the hand placed within the hybrid web-glove. The sheath-forming seams form the outer perimeter of the sheaths and run along the outer contour of the fingers they receive, upon insertion of the hand into the hybrid web-glove, having proximate sections immediately adjacent to the base of the fingers and distal sections immediately adjacent to the outer tips of the fingers. The distal sections of the sheath-forming seams are interconnected to each other with the outer edge of the distal end of the hybrid web glove, such that they completely support and reduce the stress on the hand inserted into the web-glove form, while simultaneously creating and defining webbing between each and every one of the finger-receiving sheaths; similar to the flexible webbing found in between each of the three claw-like toes of a duck's webbed foot. Such webbing provides additional cleaning surface area.

These and other objects, advantages, features, and characteristics of the invention will be apparent from the following description of a preferred embodiment, considered along with the accompanying drawings.

BRIEF DESCRIPTION OF THE DRAWINGS

It is believed that the present invention will be better understood from the following detailed description taken in conjunction with the accompanying drawings, in which the numerals represent identical elements and wherein.

LIST OF ELEMENTS AND THEIR RESPECTIVE IDENTIFYING NUMERALS

| NO | ELEMENT |
|---|---|
| 10 | Hybrid web-glove |
| 20 | First sheet |
| 30 | Second sheet |
| 40 | Fixing locations |
| 50 | Proximal end of the hybrid web-glove |
| 52 | Hand receiving opening of the hybrid web-glove |
| 60 | Distal end of the hybrid web-glove |
| 62 | Outer edge at distal end of hybrid web-glove |
| 63 | Thumb area of the hybrid web-glove |
| 64 | Inner area |
| 65 | Side of the hand opposite the base of the thumb area of the hybrid web-glove |
| 66 | Palm covering body |
| 70 | Seam-formed Endoskeleton |
| 80 | Cleaning surface webbing |
| 90 | Sheath-forming seams |
| 92 | Proximate ends of the sheath-forming seams |
| 94 | Distal ends of the sheath-forming seams |
| 100 | Sheaths |

DETAILED DESCRIPTION OF THE PREFERRED EMBODIMENT

Figure 1:
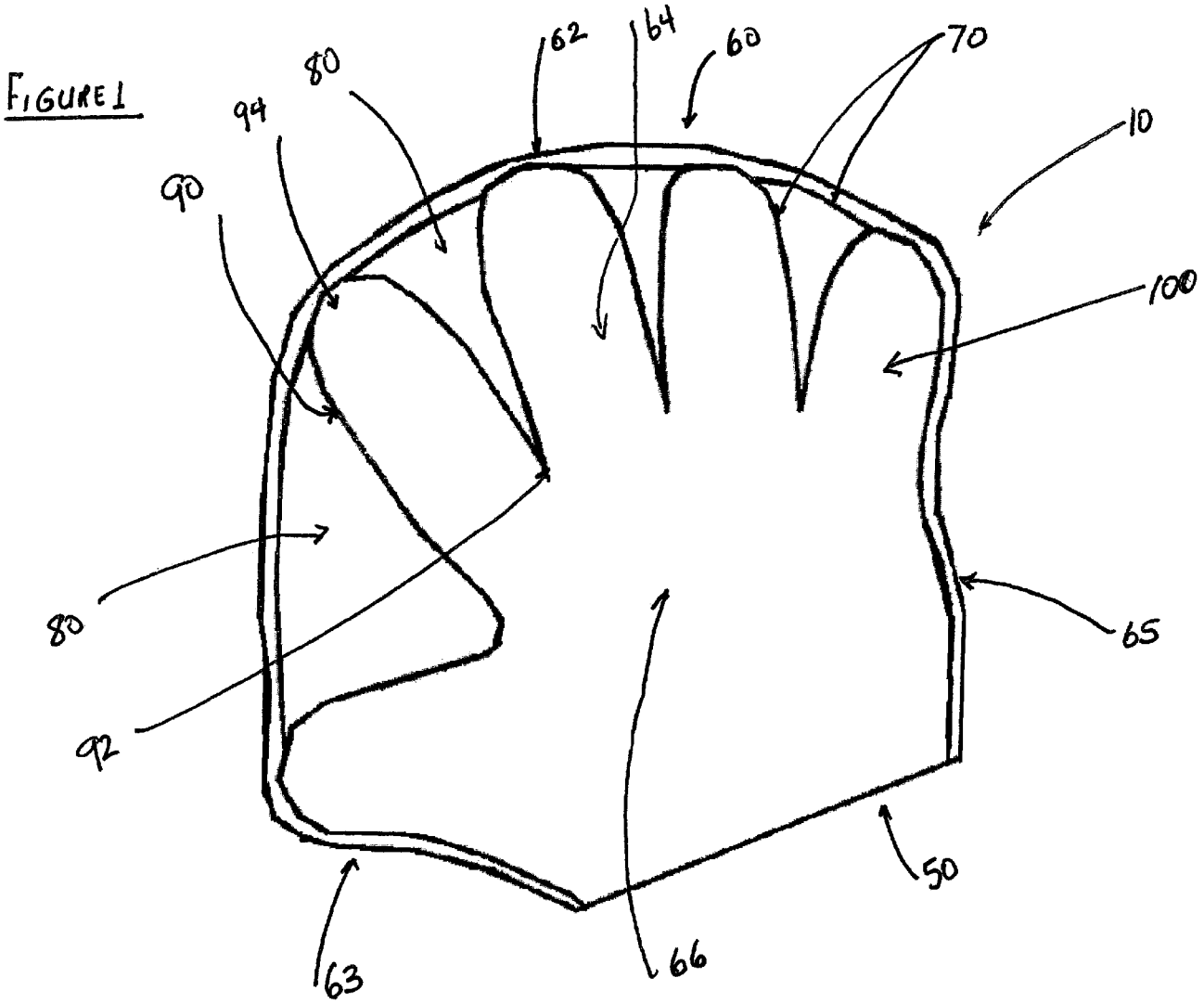
FIG. 1 is a top plan view of the inventive hybrid web glove.

Referring more specifically to FIG. 1, it generally depicts one embodiment of the reusable hybrid web-glove in accordance with the present invention at 10. It is faintly reminiscent of a duck's webbed foot. When put on during the cleaning process, it simultaneously acts as a stress releasing covering for the hand of its wearer and a cleaning tool.

Figure 2:
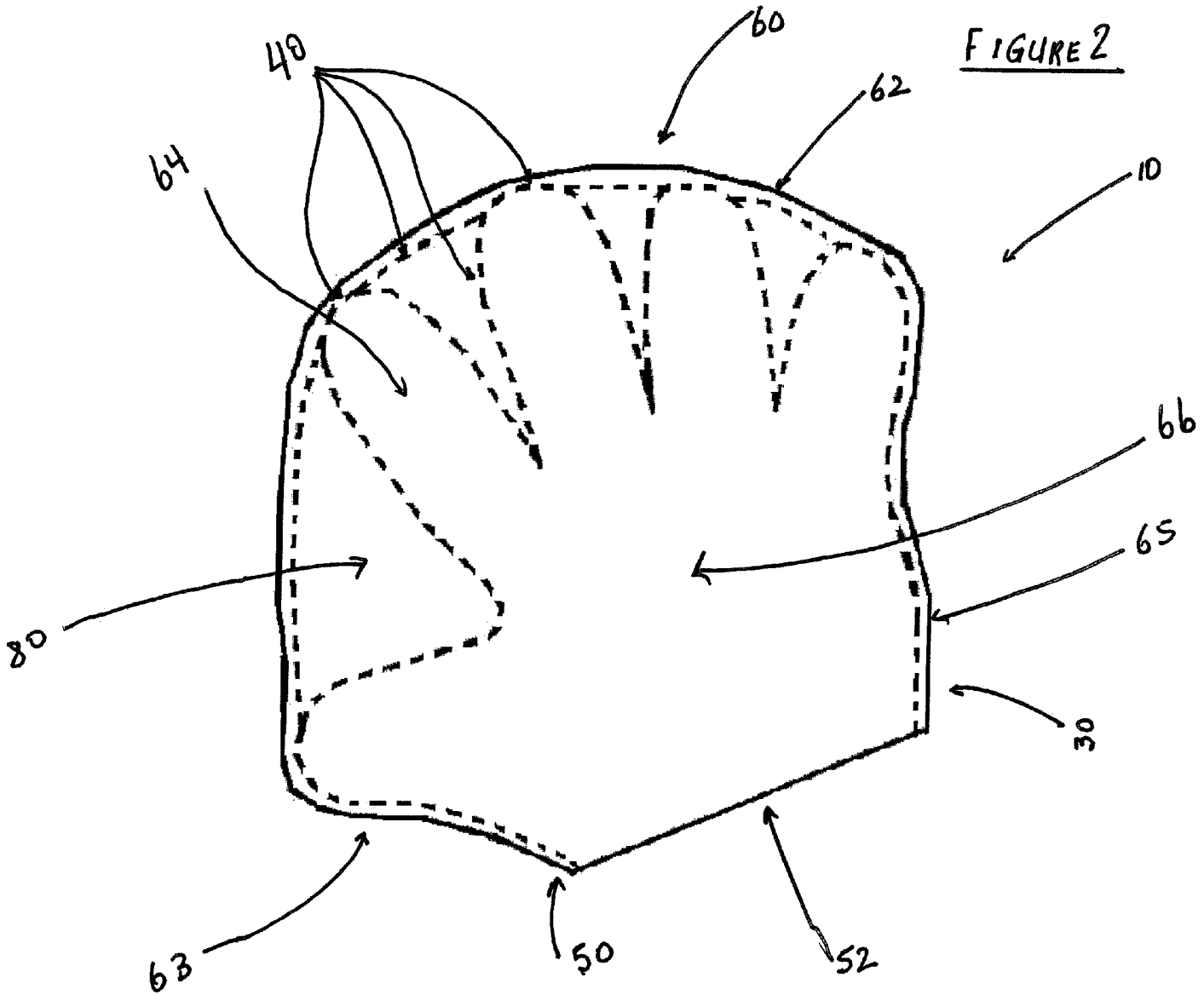
FIG. 2 is a top plan view one of the two sheets that form the inventive hybrid web glove, showing the location of the sheath forming seams.
Figure 3:
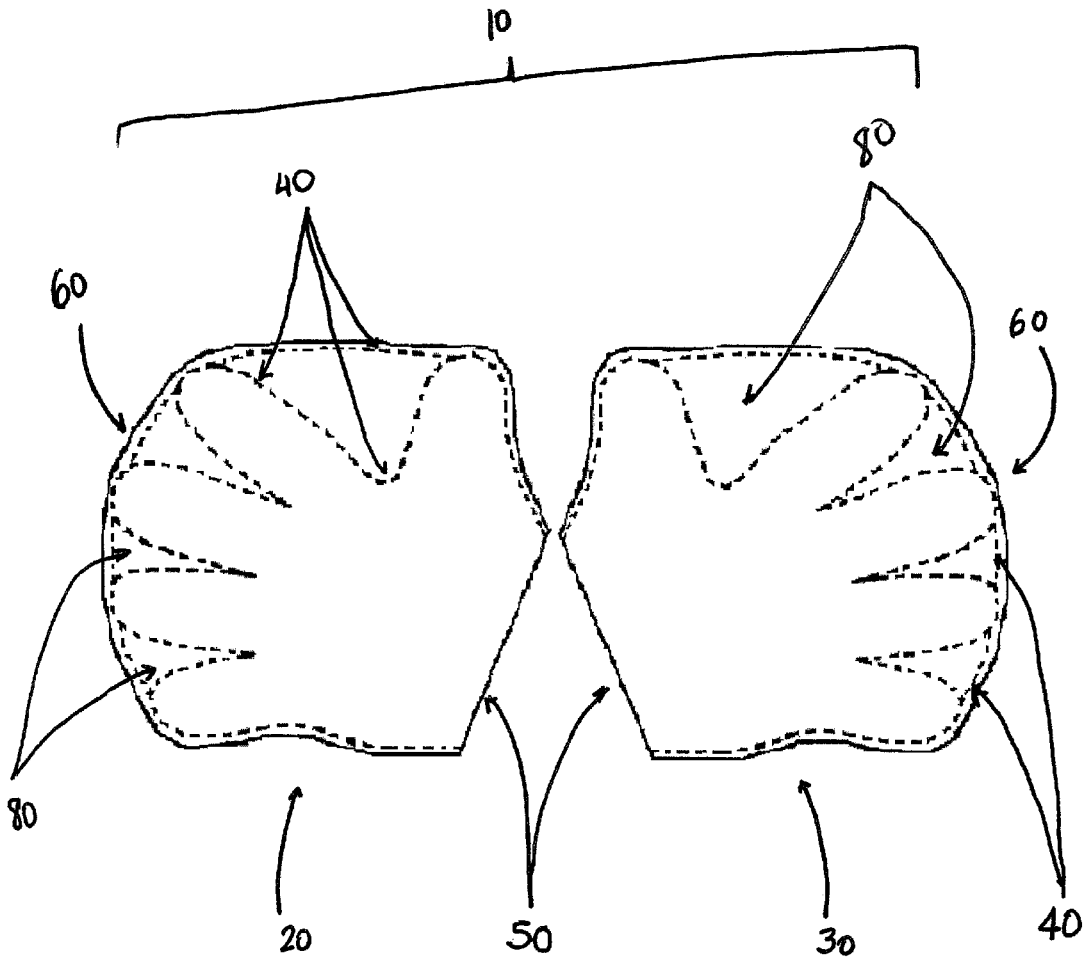
FIG. 3 is a top plan view of the two mirror image sheets that form the inventive hybrid web glove, showing the locations of the sheath forming seams.

Said embodiment of the reusable cleaning web glove 10 comprises a first sheet 20, and a second sheet 30, which are shaped in the form of the outer contour of a spread-fingered hand-print, said first and second sheets being mirror images of each other (See FIG. 3). Thus, when they are superimposed upon each other and partially fixedly secured to one another in multiple locations 40 (see FIGS. 2 and 3), the first sheet and the second sheet each form the reusable hybrid web-glove's top and bottom sheets respectively.

Said embodiment of the reusable hybrid web-glove 10 further comprises a proximal end 50, a distal end 60 having an outer edge 62, a palm covering center body 66, and a seam-formed endoskeleton 70 located between said outer edge 62 and said palm covering center body 66, said seam formed endoskeleton 70 providing form-fitting finger sheaths 100 and a webbing 80, whereby the cleaning surface of said hybrid cleaning glove is increased while the hand of a wearer of said hybrid cleaning glove is simultaneously supported.

The proximal end 50 has a cuff-free opening 52 through which the hand of the wearer can be inserted into the hybrid web-glove, in between the first sheet 20 and the second sheet 30. The cuff-free opening 52 loosely fits around the wrist of the wearer's hand to provide for, among other things, ventilation of the wearer's hand inside the glove. Ventilation of the wearer's hand while wearing the reusable hybrid web-glove is very important as it keeps the wearer's hand comfortable, relaxed and rested over the total time that the wearer is using the reusable hybrid web-glove to clean.

The distal end 60 of said reusable cleaning hybrid web-glove 10 is quasi-circular, shaped in the form of the outer contour of a spread-fingered hand-print and dimensioned so that when the hand of the wearer is inserted into the hybrid web-glove, the outer edge 62 of the distal 60 end optionally extends a bit beyond, and runs parallel to, around and along the outer contours of the widespread fingers of the hand of the wearer, generally beginning a bit below the base of the thumb area 63 and tapering towards the wrist, at the side of the hand opposite the base of the thumb area 65 to form and define the proximal end 50.

Said outer edge 62 of said distal end 60 and said palm covering center body 66 further define an inner area 64 therebetween. Said seam-formed endoskeleton 70 is located between said outer edge 62 and said palm covering center body 66, at the inner area 64.

Said seam-formed endoskeleton 70 results when various means are used to partially fixedly secure said first sheet 20 and the second sheet 30 to one another, at the numerous locations 40, thereby forming sheath 100-forming seams 90, while simultaneously creating increased cleaning surface webbing 80 between said sheaths 100. The sheaths 100 formed by the seams 90 receive the fingers of the hand placed within the hybrid web-glove 10.

Said seams 90 can be formed by sewing sheet 20 and sheet 30 at locations 40. Alternatively they can be formed by gluing or by laminating or by any other fixedly securing method. The sheath-forming seams 90 form the outer perimeter of the sheaths 100 and run along the outer contour of the fingers they receive, upon insertion of the hand into the hybrid web-glove, having proximate ends 92 immediately adjacent to the base of the fingers and distal ends 94 immediately adjacent to the outer tips of the fingers. The distal ends 94 of the sheath-forming seams 90 connect to the seam at the outer edge of the distal end of the hybrid web glove, such that they form a network of seams 90 that acts as an endoskeleton to completely support and reduce the stress on the hand inserted into the web-glove form, while simultaneously creating and defining the webbing 80 between each and every one of the finger-receiving sheaths 100; similar to the flexible webbing found in between each of the three claw-like toes of a duck's webbed foot. Such webbing 80 provides additional cleaning surface area.

Said first embodiment of the hybrid web-glove further comprises microfiber material that features split microfiber that is extremely effective for cleaning. The construction of the individual fibers allow the hybrid web-glove to pick up and hold dust, dirt and liquid better than cotton or disposable cleaning towels. The density of the yarn and the microscopic size of the individual fibers allow them to reach into the depressions and tiny crevices on the surface and remove over 99% of the bacteria they reach. Millions of tiny hooks created by the splitting process scoop up dirt and dust and keep them inside the material of the glove where they remain until laundering.

Another embodiment of the hybrid web-glove 10 further comprises a scouring pad or scouring fabric stitched on one of the two sheets 20 and 30 of the reusable cleaning web glove 10. The scouring pad or fabric can be stitched in such a way that when the wearer puts on the hybrid web-glove 10, the scouring fabric or pad covers the entire palm area of the hybrid web-glove, and optionally through its entire webbing and the sheaths 100, to the outer perimeter of its distal end 60. Alternatively, the scouring fabric or pad can be stitched solely on the webbing and the sheaths, through the outer perimeter of the distal end 60 of the hybrid web-glove 10. The scouring fabric or pad will allow the wearer to use the hybrid web-glove 10 to clean pots, pans, ovens, racks, garden tools, barbeques and other hard to clean surfaces with very little effort, while simultaneously significantly reducing the cleaning time usually associated with such cleaning task because: a) it has increased cleaning surface area; and b) it allows the user to apply full hand force on the area that needs to be cleaned. The user can wrap his or her hand around the rods of a grill or a rack that needs to be cleaned, thereby applying more power to the scouring of such rods.

Said scouring pad embodiment of said hybrid web-glove 10 can further comprise an inner removable or fixedly connected rubber glove or sheath, or an inner moisture-impermeable or moisture-resistant layer or barrier such that when the wearer uses the hybrid web-glove 10 for difficult scouring tasks using water, the wearer's hand remains dry and comfortable.

Yet another embodiment of said hybrid web-glove 10 further comprises or is further provided with a peel-and-use sticky surface on one or both of the two sheets 20 and 30 of the reusable cleaning web glove 10. The peel and use sticky surface can be stitched or fixed on the hybrid web-glove in such a way that when the wearer puts on the hybrid web-glove 10, the sticky surface covers the entire palm area of the hybrid web-glove, through its entire webbing and the sheaths, to the outer perimeter of its distal end 60. Alternatively, the sticky surface can be stitched or fixedly applied solely on the webbing and the sheaths, through the outer perimeter of the distal end 60 of the hybrid web-glove 10. The sticky surface, once exposed by peeling its protective covering, will allow the wearer to use the hybrid web-glove 10 to remove pet hair, dust and lint from fabrics normally associated with furniture, bed spreads, curtains, drapes and clothing with very little effort, while simultaneously significantly reducing the cleaning time usually associated with such cleaning tasks. When done, all that the wearer has to do is just peel off the sticky surface, exposing a new peel and use sticky surface beneath, and throw the used sticky surface away.

Alternatively, the peel and use sticky surface could be adhered to the hybrid web-glove by the wearers themselves. The peel and use sticky surface is supplied to the hybrid web-glove users in the form of a roll of double sided tape shaped in the form of said hybrid web-glove. The wearer could purchase the roll, remove the protective covering, apply the tape to the palm side of the hybrid web-glove, use the other side of the tape to remove the pet hair, dust or lint, and when done removing the lint or dust or pet hairs, just peel the tape off the hybrid web-glove and throw it away. All the wearer would have to do next time is to reapply a new peel and use sticky surface from the roll he or she purchased.

Still another embodiment of said hybrid web-glove 10 further comprises or is further provided with a padded surface, such as cotton padding, batting, cotton balls, and other, on one or both of the two sheets 20 and 30 of the reusable cleaning web glove 10. The padding can be stitched or fixed on the hybrid web-glove in such a way that when the wearer puts on the hybrid web-glove 10, the padding covers the entire palm area of the hybrid web-glove, through its entire webbing and the sheaths, to the outer perimeter of its distal end 60. Alternatively, the padding can be stitched or fixedly applied solely on the webbing and the sheaths, through the outer perimeter of the distal end 60 of the hybrid web-glove 10. The padding will protect the wearer from getting pricked when the wearer uses the hybrid web-glove 10 to remove hair from a hair brush.

The process of using the hybrid web-glove includes slipping the hand of an individual desiring to clean, into the hybrid web-glove through the opening 52 at the proximate end 50 of the hybrid web-glove 10, such that the hand is sandwiched between the first and second sheets 20 and 30 respectively and each of the fingers of the hand is fully encased by each of the sheaths 100 respectively, preparing to clean by spreading the hands fingers such that the supporting skeleton of seams 90 fully support the hand, and using the glove to clean.

There is no question that the inventive hybrid web-glove described herein above, accomplishes all of its objectives. To wit: clean and dust without any harmful chemicals, cut cleaning time by a significant amount, deliver high cleaning performance with little effort, is machine washable, while simultaneously providing maximum comfort and little fatigue over its long term cleaning and dusting use.

While particular embodiments of the invention have been illustrated and described in detail herein, they are provided by way of illustration only and should not be construed to limit the invention. Since certain changes may be made without departing from the scope of the present invention, it is intended that all matter contained in the above description, or shown in the accompanying drawings be interpreted as illustrative and not in a literal sense. Practitioners of the art will realize that the sequence of steps and the embodiments depicted in the figures can be altered without departing from the scope of the present invention and that the illustrations contained herein are singular examples of a multitude of possible depictions of the present invention.

Accordingly, I claim:

1. A hybrid cleaning glove comprising:

a. a proximal end;

b. a quasi-circular distal end contoured in the form of the outer perimeter of a spread-fingered hand-print, said contour beginning slightly below the base of the spread-fingered hand-print thumb area, travelling along the outer tips of the spread fingertips and tapering towards the spread-fingered hand-print edge opposed to said thumb area;

c. a palm-and-fingers covering body located between said proximal and quasi-circular distal ends;

d. and, seams within said palm-and-fingers covering body, and along the outer perimeter of said quasi-circular distal end, said seams positioned to sealably form the hybrid cleaning glove's finger-receiving sheaths and outer distal edge; said finger-receiving sheaths having proximal and distal ends, said distal ends of said finger-receiving sheaths contiguous to the seams sealably forming the outer perimeter of said quasi-circular distal end of said hybrid, cleaning glove; thereby forming an endoskeleton, defining and supporting quasi-triangular webbing between said finger-sheaths and the distal outer edge of said hybrid cleaning glove to comfortably support the hand of a wearer in a constant spread-fingered position, while simultaneously maximizing the cleaning area of said hybrid cleaning glove.

2. The hybrid cleaning glove according to claim 1, further comprising a cuff-free opening at said proximal end, through which the hand of a wearer can be inserted and ventilated during use.

* * * * *